United States Patent [19]

Seebinger

[11] 3,997,724

[45] Dec. 14, 1976

[54] LOUDSPEAKER DRIVE MECHANISM MONITORING ASSEMBLY

[75] Inventor: Frederick L. Seebinger, Smoke Rise, N.J.

[73] Assignee: American Trading and Production Corporation, Baltimore, Md.

[22] Filed: June 3, 1975

[21] Appl. No.: 583,372

[52] U.S. Cl. ..... 179/1 MN; 179/175.1 A

[51] Int. Cl.[2] ..... H04R 29/00

[58] Field of Search ..... 179/1 MN, 175.1 A, 115.5 DV; 324/98, 140 R; 328/146, 149

[56] References Cited

UNITED STATES PATENTS 3,855,415 12/1974 Fox et al. ..... 179/1 MN

FOREIGN PATENTS OR APPLICATIONS 41-20407 6/1966 Japan ..... 179/1 MN

*Primary Examiner*—Douglas W. Olms

*Attorney, Agent, or Firm*—Blum, Moscovitz, Friedman & Kaplan

[57] ABSTRACT

A loudspeaker drive mechanism monitoring assembly includes a detection coil for detecting the operative state of a loudspeaker drive mechanism. The loudspeaker drive mechanism includes a permanent magnet assembly defining an air gap having a flux field therein and a voice coil adapted to receive a drive signal, the voice coil being disposed in the flux field to affect a change thereof in response to a drive signal applied thereto. The detection coil is wrapped around a portion of the permanent magnet or magnetic assembly and has a detection signal induced therein in response to the application of a drive signal to the voice coil.

3 Claims, 4 Drawing Figures

LOUDSPEAKER DRIVE MECHANISM MONITORING ASSEMBLY

BACKGROUND OF THE INVENTION

This invention generally relates to a loudspeaker monitoring assembly, and in particular to a loudspeaker drive mechanism monitoring assembly adapted to be connected to detection circuitry capable of monitoring operative conditions of said loudspeaker drive assembly.

Heretofore, two prevalent causes of loudspeaker malfunctioning have been lead failures and burned out voice coils. Accordingly, when a loudspeaker is used in a life safety system it is imperative that monitoring equipment be provided to guaranty the operability of the loudspeaker during extended periods of inactivity between uses.

Accordingly, loudspeaker monitoring arrangements have taken on various forms. For example, a 25 Hz—¼ watt test signal is applied to a first loudspeaker voice coil, and a second voice coil is disposed proximate the loudspeaker voice coil for sensing the test signal and applying same to a sense amplifier coupled thereto. Nevertheless, the use of a second voice coil as the sensing element adds mass to the moving system resulting in a considerable reduction in the efficiency of the loudspeaker voice coil. Additionally, a second voice coil requires another set of leads in the loudspeaker drive mechanism which reduces the reliability of the loudspeaker drive mechanism and hence is less than completely satisfactory.

SUMMARY OF THE INVENTION

Generally speaking, in accordance with the invention, a loudspeaker drive mechanism monitoring assembly adapted to monitor the operative conditions of a loudspeaker is provided. A permanent magnet assembly defines an air gap having a flux field therein. A voice coil is adapted to receive a drive signal and is disposed with respect to the air gap to effect a change in the flux field therein in response to a drive signal applied thereto. A detection coil is wrapped around a portion of the permanent magnet assembly. A detection signal representative of the operative condition of the loudspeaker drive mechanism is induced in the detection coil in response to the application of a drive signal to the voice coil.

Accordingly, an object of this invention is to provide an improved loudspeaker drive mechanism monitoring assembly.

A further object of this invention is to provide an improved monitoring assembly for indicating an inoperative condition of a loudspeaker drive mechanism.

Still a further object of this invention is to provide an improved loudspeaker drive mechanism monitoring assembly for use in loudspeaker life safety and security applications.

Still another object of this invention is to provide a loudspeaker drive mechanism monitoring assembly having no moving elements.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
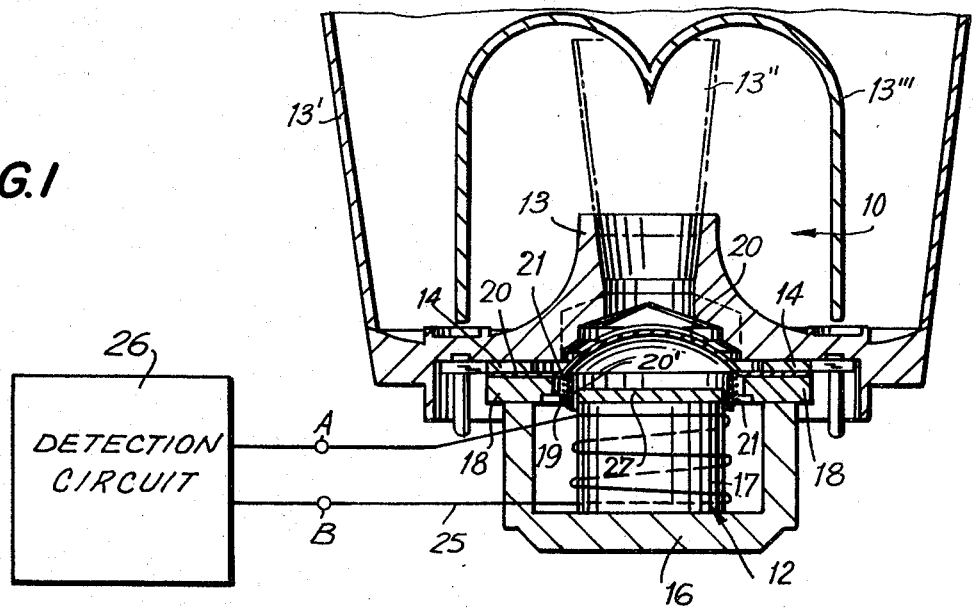
FIG. 1 is a section view of a slug magnet horn loudspeaker drive mechanism including a monitoring assembly constructed in accordance with a preferred embodiment of the instant invention.

Reference is now made to FIG. 1 wherein a horn loudspeaker, generally indicated at 10, is depicted. The loudspeaker includes a conventional slug magnet loudspeaker drive mechanism assembly generally indicated as 12, secured to a sound chamber element 13 including an outer horn 13', and inner horns 13'' and 13''' and spaced apart therefrom by diaphragm spacers 14. The slug magnet loudspeaker drive mechanism assembly 12 includes a unitary magnetic permeable cup piece 16, secured to sound chamber element 13, to dispose a top plate 18 having a circular opening 19 between a diaphragm 20 and the unitary cup piece 16. The loudspeaker drive mechanism assembly further includes a slug type permanent magnet 17 having a pole cap 27, formed of a magnetic permeable material such as steel and the like, concentrically disposed with respect to the circular opening 19 in top plate 18 to form an annular air gap therebetween. Diaphragm 20 is secured between top plate 18 and diaphragm spacer 14 and includes a cylindrical element 20' secured thereto for supporting a voice coil 21 in the annular air gap defined by the circular opening in the top plate 18 and the pole cap 27. The loudspeaker is operated in a conventional manner whereby either an AC or pulsed DC signal is applied to the voice coil to effect a vibration of the diaphragm to generate the desired acoustic energy.

A detection pick-up coil 25 is wrapped around the permanent magnet and includes end terminals A and B for connecting the detection coil to a detection circuit 26. In response to an AC drive signal applied to the voice coil 21, and AC signal proportional to the AC signal applied to the voice coil is induced in pick-up coil 25. Accordingly, in the event that an amplifier or transmission line causes a system failure or that the voice coil is opened by lead failure or is burned out, no energy will be induced in the pick-up coil, and a detection circuit capable of providing audio, mechanical or light indication will indicate the inoperative state of the loudspeaker. Accordingly, a simple loudspeaker drive mechanism monitoring assembly having increased reliability, without impairing the efficiency of the loudspeaker, is provided. Moreover, as detailed hereinafter with respect to the further embodiments of the instant invention, monitoring of a plurality of operating characteristics of a loudspeaker is possible by use of the instant invention.

Figure 2:
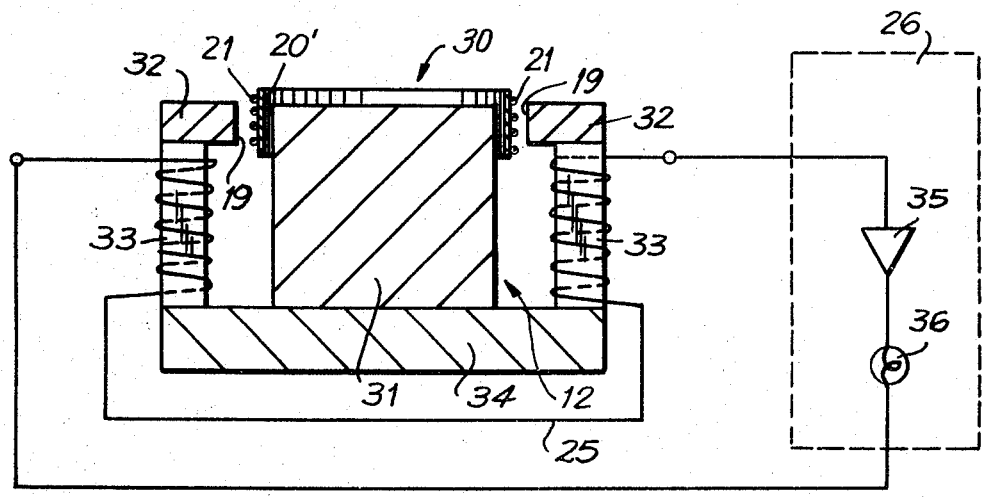
FIG. 2 is a partial sectional view of a bar magnet loudspeaker drive mechanism arrangement including a monitoring circuit arrangement constructed in accordance with an alternate embodiment of the instant invention.

Reference is now made to FIG. 2 wherein a loudspeaker drive mechanism generally indicated at 30 is depicted, like reference numerals being utilized to denote like elements depicted in FIG. 1. The permanent magnet drive assembly 12 is of the bar magnet variety and includes two permanent magents 33, a magnetic permeable center pole piece 31, a magnetic permeable bottom plate 34 supporting the center pole piece 31 and a top plate 32 defining a circular opening 19 concentrically disposed with respect to said center pole piece to define an annular air gap therebetween. A voice coil 21 is disposed in the annular air gap formed between the top plate 32 and center pole piece 31. Pick-up coil 25 is wrapped in series around permanent magnets 33 and is coupled at terminals A and B to a detection circuit 26. Detection circuit 26 includes an amplifier 35 coupled in series to a lamp 36, the lamp 36 being lit in response to a signal induced across terminals A and B of the pickup coil 25. The application of an AC signal to the voice coil 21 to effect operation of a loudspeaker will induce in the pickup coil 25 an AC signal proportional to the signal applied to the voice coil 21. Light source 36 will be lit in response to the application of a signal to the voice coil 21 and if same is not lit, will provide an indication that the loudspeaker drive mechanism is inoperative.

Figure 3:
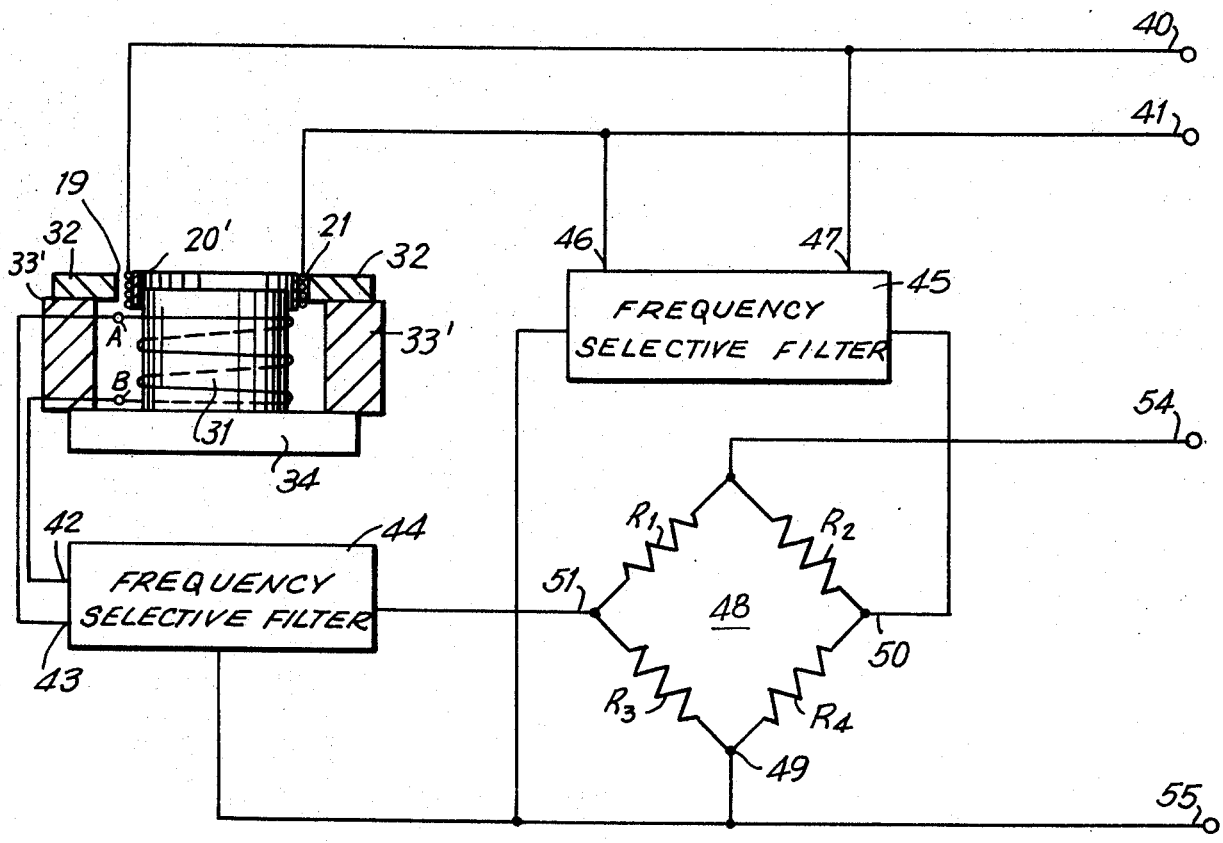
FIG. 3 is a partial sectional view of a ring magnet loudspeaker drive mechanism arrangement including still another monitoring circuit arrangement constructed in accordance with still a further alternate embodiment of the instant invention.

Reference is now made to FIG. 3 wherein another monitoring circuit assembly for a ring magnet loudspeaker drive mechanism including ring magnet 33' is depicted, like reference numerals being utilized to denote like elements depicted in FIG. 2. The pick-up coil 25 is wrapped around center pole piece 31 of the ring type permanent magnet drive assembly 12, and is provided with terminals A and B for connecting the pick-up coil 25 to a suitable detection circuit. The detection circuit depicted in FIG. 3 is an example of a circuit for monitoring increases in ambient temperature of a loudspeaker and/or sudden surges of power applied to a loudspeaker voice coil, conditions which are likely to cause damage to the loudspeaker drive mechanism.

Referring specifically to the detection circuit depicted in FIG. 3, a frequency selective filter 45 includes input terminals 46 and 47 coupled to the respective terminals 40 and 41 of voice coil 21 and is also coupled to input terminals 49 and 50 of a bridge circuit, generally indicated as 48. A second frequency selective filter 44 includes input terminals 42 and 43 respectively coupled to output terminals B and A of the detection pick-up coil 25, and is also coupled to input terminals 49 and 51 of bridge circuit 48. Frequency selective filters 44 and 45 are adapted to detect a peak to peak voltage at a particular selected monitoring frequency. Accordingly, such frequency selective filters are particularly suitable for use in monitoring a siren tone or a particular audio band in a loudspeaker. Bridge circuit 48 includes resistors $R_1$, $R_2$, $R_3$ and $R_4$, which resistors are selected to effect a balanced condition during normal operation of the loudspeaker drive system. However, a rapid increase in the ambient temperature of the loudspeaker will cause a rise in the impedance of the voice coil, and therefore a resultant IR loss, which loss will be detected in the peak to peak voltage detected by frequency selective filter 45 thereby causing an unbalanced condition and hence a signal output across output terminals 54 and 55 of bridge circuit 47. Similarly, a sudden surge in power applied to the voice coil will cause a corresponding rise in the temperature of the voice coil and hence the same unbalanced condition of the bridge circuit noted above. Accordingly, the signal produced in response to the unbalanced condition of the birdge circuit 48 can be applied to a power control circuit of the loudspeaker to thereby decrease the power applied to the voice coil to thereby protect the voice coil from being damaged by a sudden rise in the ambient temperature or a surge of power applied thereto.

Figure 4:
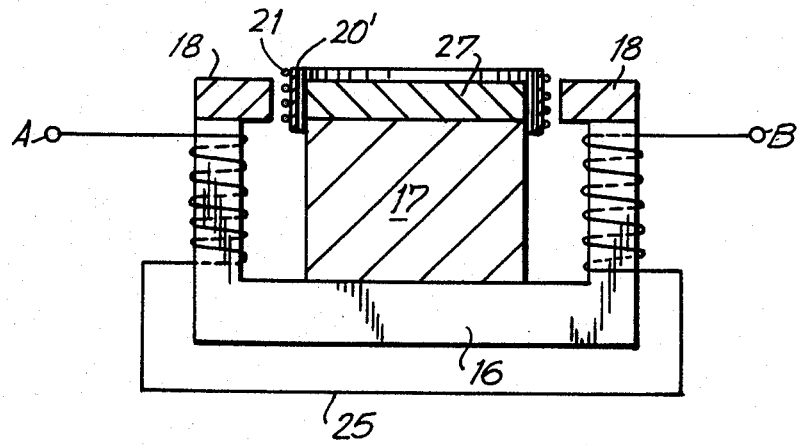
FIG. 4 is a partial sectional view of a slug magnet loudspeaker drive mechanism including a monitoring assembly constructed in accordance with still a further alternate embodiment of the instant invention.

Reference is now made to FIG. 4 wherein still a further embodiment of a loudspeaker drive mechanism monitoring assembly in accordance with the instant invention is depicted, like reference numerals being utilized to denote like elements depicted in FIG. 1. The detection pick-up coil 25 is wrapped in series around two pole portions, and an AC signal is induced therein in response to the application of a drive signal to the voice coil 21 in the same manner detailed above. Accordingly, pick-up coil 25 is adapted for use with the detection circuit detailed above, or any further detection circuit capable of monitoring the operative conditions of the loudspeaker drive mechanism.

It is noted that although the instant invention is described in a horn speaker, the loudspeaker drive mechanism arrangement is equally suited for use in cone speakers. It is further noted that each of the particular loudspeaker drive mechanism arrangements described above, namely, bar, ring and slug magnets and illustrated in FIGS. 1 through 4 are suitable for use with the detection circuits disclosed in FIGS. 2 and 3 and additionally with detection circuits well known in the art capable of monitoring the operative state of a lousspeaker in response to the AC signal induced in the detection pick-up coil being applied thereto.

It will thus be seen that the objects set forth above, among those made apparent from the preceding description, are aefficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A loudspeaker drive mechanism monitoring assembly comprising in combination, permanent magnet means defining an air gap having a flux field therein, voice coil means adapted to receive a drive signal applied thereto, said voice coil being disposed in said flux field to effect a change thereof in response to a drive signal applied to said voice coil, detection coil means wrapped around said permanent magnet means, said detection coil means having a detection signal induced therein in response to the application of a drive signal to said voice coil, said detection signal being representative of an operative state of said loudspeaker drive mechanism and a detection circuit having a first circuit means coupled to said voice coil means for sensing a signal applied thereto, second circuit means coupled to said detection coil means for sensing the detection signal induced therein, and comparator means coupled to said first and second circuit means for comparing the respective signals sensed thereby, and producing a singal representative of an operative condition of said loudspeaker drive mechanism.

2. A loudspeaker drive mechanism monitoring assembly as claimed in claim 1, wherein said first and second circuit means are frequency selective filters adapted to detect a peak voltage at a predetermined frequency.

3. A loudspeaker drive mechanism monitoring assembly as claimed in claim 2, wherein said comparator means is a selectively variable resistive bridge.

* * * * *